US011525607B2

(12) United States Patent
Ebara et al.

(10) Patent No.: US 11,525,607 B2
(45) Date of Patent: Dec. 13, 2022

(54) CRYOGENIC COOLING SYSTEM

(71) Applicant: SUMITOMO HEAVY INDUSTRIES, LTD., Tokyo (JP)

(72) Inventors: Yuta Ebara, Kanagawa (JP); Takaaki Morie, Kanagawa (JP); Jyun Yoshida, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 56 days.

(21) Appl. No.: 16/940,992

(22) Filed: Jul. 28, 2020

(65) Prior Publication Data

US 2020/0355409 A1 Nov. 12, 2020

Related U.S. Application Data

(63) Continuation of application No. PCT/JP2018/041618, filed on Nov. 9, 2018.

(30) Foreign Application Priority Data

Jan. 29, 2018 (JP) ..... JP2018-012577

(51) Int. Cl.
*F25B 49/02* (2006.01)
*F25B 9/14* (2006.01)
(Continued)

(52) U.S. Cl.
CPC ..... *F25B 9/145* (2013.01); *F25B 49/02* (2013.01); *F17C 3/08* (2013.01); *F17C 3/10* (2013.01); *F17C 2250/0443* (2013.01)

(58) Field of Classification Search
CPC .. F25B 9/145; F25B 49/02; F17C 3/08; F17C 3/10; F17C 2250/0161; F17C 2223/0161
See application file for complete search history.

(56) References Cited

U.S. PATENT DOCUMENTS 6,679,066 B1 * 1/2004 Funayama ..... F17C 3/08 62/50.2
2006/0097146 A1 5/2006 Strobel
(Continued)

FOREIGN PATENT DOCUMENTS

JP S64-014559 A 1/1989
JP 2000-121192 A 4/2000
(Continued)

OTHER PUBLICATIONS

Otani, Cryogenic Refrigerator, 2010, Full Document (Year: 2010).*
(Continued)

*Primary Examiner* — Nael N Babaa
(74) *Attorney, Agent, or Firm* — Michael Best & Friedrich LLP

(57) ABSTRACT

A cryogenic cooling system includes a gas circulation source; a cryocooler that cools a cooling gas; a cooling gas flow path that causes a cooling gas to flow from the gas circulation source to the object to be cooled; and a control device that controls the gas circulation source so as to execute initial cooling of the object to be cooled according to a prescribed flow rate pattern. The prescribed flow rate pattern is predetermined such that the cooling gas flows through the cooling gas flow path at a first average flow rate, and the cooling gas flows through the cooling gas flow path at a second average flow rate. The second average flow rate is smaller than the first average flow rate such that the cooling capacity of the cryogenic cooling system is increased.

6 Claims, 7 Drawing Sheets

(51) Int. Cl.
*F17C 3/08* (2006.01)
*F17C 3/10* (2006.01)

(56) References Cited

U.S. PATENT DOCUMENTS

| | | | |
|---|---|---|---|
| 2017/0038123 | A1 | 2/2017 | Strickland et al. |
| 2019/0011169 | A1 | 1/2019 | Oikawa |

FOREIGN PATENT DOCUMENTS

| | | | | |
|---|---|---|---|---|
| JP | 2011-141074 | A | | 7/2011 |
| JP | 2011141074 | A | * | 7/2011 |
| WO | 2015159258 | A1 | | 10/2015 |
| WO | 2017159580 | A1 | | 9/2017 |

OTHER PUBLICATIONS

EPC Article 94(3) Communication issued in European Application No. 18902343.5, dated Feb. 22, 2021.
Search Report issued in European Application No. 18902343.5, dated Feb. 9, 2021.
International Search Report issued in Application No. PCT/JP2018/041618, dated Jan. 22, 2019.

* cited by examiner

CRYOGENIC COOLING SYSTEM

RELATED APPLICATIONS

The contents of Japanese Patent Application No. 2018-012577, and of International Patent Application No. PCT/JP2018/041618, on the basis of each of which priority benefits are claimed in an accompanying application data sheet, are in their entirety incorporated herein by reference.

BACKGROUND

Technical Field

Certain embodiment of the present invention relates to a cryogenic cooling system.

Description of Related Art

Circulation cooling system that cools an object to be cooled such as a superconducting electromagnet with a gas cooled to a cryogenic temperature have been known from the past. A cryocooler such as a Gifford-McMahon (GM) refrigerator is often used for cooling the cooling gas.

SUMMARY

According to an embodiment of the present invention, there is provided a cryogenic cooling system including a gas circulation source that circulates a cooling gas; a cryocooler including a cryocooler stage that cools the cooling gas; a cooling gas flow path that causes a cooling gas to flow from the gas circulation source via the cryocooler stage and the object to be cooled to the gas circulation source; and a control device that controls the gas circulation source to execute initial cooling of the object to be cooled from a room temperature to a target cooling temperature according to a prescribed flow rate pattern. The prescribed flow rate pattern is predetermined such that the cooling gas flows into the cooling gas flow path at a first average flow rate from the start of the initial cooling to the transition timing, and the cooling gas is flows through the cooling gas flow path at a second average flow rate from the transition timing to completion of the initial cooling. The second average flow rate is smaller than the first average flow rate such that the cooling capacity of the cryogenic cooling system is increased as compared to a case where the first average flow rate is maintained from the transition timing to the completion of the initial cooling.

In addition, any combinations of the above-described components, and mutual substitutions of the components and expressions of the present invention between methods, apparatuses, systems, and the like are also effective as aspects of the present invention.

DETAILED DESCRIPTION

In the cryogenic cooling systems, initial cooling is performed to cool the object to be cooled from the room temperature to the target cooling temperature when the system is activated. The object to be cooled can be used after the completion of the initial cooling. Therefore, it is desired that the time required for the initial cooling be as short as possible.

It is desirable to shorten the initial cooling time of a cryogenic cooling system.

Hereinafter, embodiments for carrying out the present invention will be described in detail with reference to the drawings. In the description and drawings, the same or equivalent components, members, and processing are designated by the same reference signs, and redundant description will be appropriately omitted. The scales and shapes of the respective parts illustrated in the figures are set for the sake of convenience for facilitating description, and should not be interpreted as limiting unless otherwise specified. The embodiments are examples and does not limit the scope of the present invention. All the features and combinations described in the embodiments are not necessarily essential to the invention.

Figure 1:
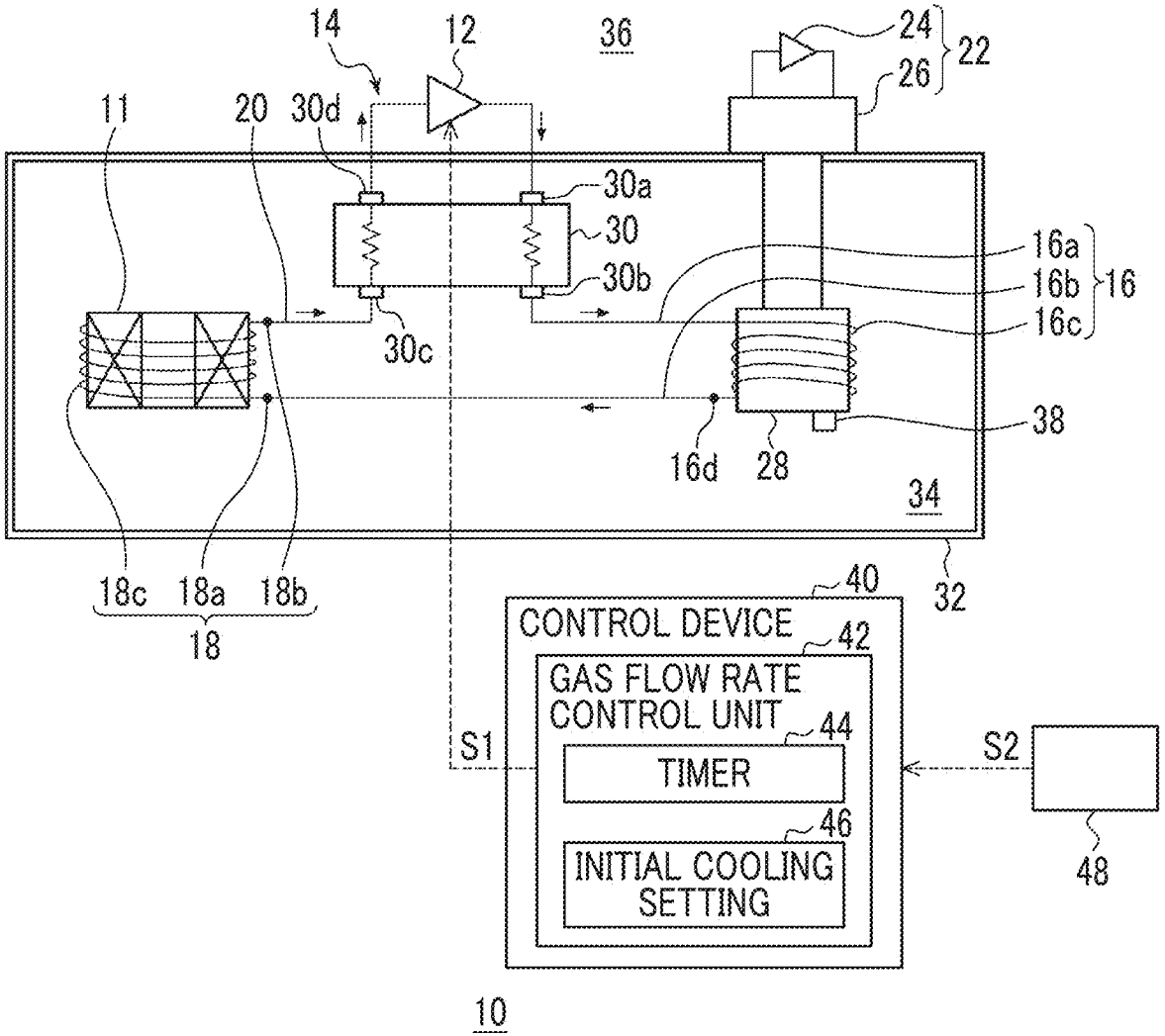
FIG. 1 is a view schematically illustrating a cryogenic cooling system according to an embodiment.

FIG. 1 is a view schematically illustrating a cryogenic cooling system 10 according to an embodiment. The cryogenic cooling system 10 is a circulation cooling system configured to cool the object 11 to be cooled to a target temperature by circulating a cooling gas. As the cooling gas, for example, helium gas is often used, but another gas suitable for the cooling temperature may be utilized.

The object 11 to be cooled is, for example, a superconducting electromagnet. The superconducting electromagnet is mounted on, for example, a particle accelerator used for a particle beam therapy apparatus or other apparatus, or another superconducting apparatus. In addition, needless to say, the object 11 to be cooled is not limited to the superconducting electromagnet. The object 11 to be cooled may be other equipment or fluid for which cryogenic cooling is desired.

The target cooling temperature is a desired cryogenic temperature selected from a temperature range from a predetermined lower limit temperature to a predetermined upper limit temperature. The lower limit temperature is, for example, a lowest temperature at which cooling can be made by the cryogenic cooling system 10, and may be, for example, 4 K. The upper limit temperature is, for example, a desired cryogenic temperature selected from a temperature range equal to or lower than a superconducting critical temperature. The superconducting critical temperature is determined in accordance with a superconducting material to be used, but is, for example, a liquid nitrogen temperature or lower, or a cryogenic temperature of 30 K or lower, 20 K or lower, or 10 K or lower. Therefore, the target cooling temperature is selected from the temperature region of 4 K to 30 K, or the temperature range of 10 K to 20 K, for example.

The cryogenic cooling system 10 includes a gas circulation source 12 that circulates a cooling gas, and a cooling gas flow path 14 through which the cooling gas flows to cool the object 11 to be cooled. The gas circulation source 12 is configured to control the supplied cooling gas flow rate according to a gas circulation source control signal S1. The gas circulation source 12 includes, for example, a compressor that pressure-increases and delivers the recovered cooling gas. The cooling gas flow path 14 includes a gas supply line 16, a object-to-be-cooled gas flow path 18, and a gas recovery line 20. The gas circulation source 12 and the cooling gas flow path 14 constitute a cooling gas circulation circuit. Several arrows drawn along the cooling gas flow path 14 in FIG. 1 indicate the flow direction of the cooling gas.

The gas circulation source 12 is connected to the gas recovery line 20 so as to recover the cooling gas from the gas recovery line 20, and is also connected to the gas supply line 16 so as to supply the pressure-increased cooling gas to the gas supply line 16. In addition, the gas supply line 16 is connected to the object-to-be-cooled gas flow path 18 so as to supply the cooling gas to the object-to-be-cooled gas flow path 18, and the gas recovery line 20 is connected to the object-to-be-cooled gas flow path 18 so as to recover the cooling gas from the object-to-be-cooled gas flow path 18.

The gas supply line 16, the object-to-be-cooled gas flow path 18, and/or the gas recovery line 20 may be flexible pipes or rigid pipes.

The cryogenic cooling system 10 includes a cryocooler 22 that cools the cooling gas of the cryogenic cooling system 10. The cryocooler 22 includes a compressor 24, and a cold head 26 including a cryocooler stage 28.

The compressor 24 of the cryocooler 22 is configured to recover the working gas of the cryocooler 22 from the cold head 26, pressure-increases the collected working gas, and supply the working gas to the cold head 26 again. The compressor 24 and the cold head 26 constitute a circulation circuit for the working gas, that is, a refrigeration cycle of the cryocooler 22, and the cryocooler stage 28 is cooled by the refrigeration cycle. The working gas is typically helium gas, but any other suitable gas may be used. The cryocooler 22 is, for example, a Gifford-McMahon (GM) cryocooler, but may be a pulse tube cryocooler, a Sterling cryocooler, or another cryocooler.

The compressor 24 of the cryocooler 22 is provided separately from the gas circulation source 12. The working gas circulation circuit of the cryocooler 22 is fluidly isolated from the cooling gas circulation circuit of the cryogenic cooling system 10.

The object-to-be-cooled gas flow path 18 is provided around or inside the object 11 to be cooled for flowing the cooling gas. The object-to-be-cooled gas flow path 18 includes an inlet 18*a*, an outlet 18*b*, and a gas pipe 18*c* extending from the inlet 18*a* to the outlet 18*b*. The gas supply line 16 is connected to the inlet 18*a* of the object-to-be-cooled gas flow path 18, and the gas recovery line 20 is connected to the outlet 18*b* of the object-to-be-cooled gas flow path 18. Therefore, the cooling gas flows into the gas pipe 18*c* from the gas supply line 16 through the inlet 18*a*, and further flows out from the gas pipe 18*c* through the outlet 18*b* to the gas recovery line 20.

The gas pipe 18*c* is in physical contact with the object 11 to be cooled and thermally coupled to the object 11 to be cooled such that the object 11 to be cooled is cooled by heat exchange between the cooling gas flowing in the gas pipe 18*c* and the object 11 to be cooled. As an example, the gas pipe 18*c* is a coil-shaped cooling gas pipe disposed in contact with an outer surface of the object 11 to be cooled so as to surround the periphery of the object 11 to be cooled.

In a case where the object-to-be-cooled gas flow path 18 is configured as a piping member separate from the gas supply line 16, the inlet 18*a* may be a pipe coupling provided at one end of the gas pipe 18*c* for connecting the gas supply line 16 to the object-to-be-cooled gas flow path 18. In a case where the object-to-be-cooled gas flow path 18 is configured as an integrated piping member that is continuous from the gas supply line 16, the inlet 18*a* refers to a location where the gas pipe 18*c* starts physical contact with the object 11 to be cooled, or this contact start point may be regarded as the inlet 18*a* of the object-to-be-cooled gas flow path 18. In addition, in a case where the object-to-be-cooled gas flow path 18 passes through the inside of the object 11 to be cooled, the inlet 18*a* may literally refer to a part where the object-to-be-cooled gas flow path 18 enters the object 11 to be cooled.

Similarly, in a case where the object-to-be-cooled gas flow path 18 is configured as a piping member separate from the gas recovery line 20, the outlet 18*b* may be a pipe coupling provided at the other end of the gas pipe 18*c* in order to connect the gas recovery line 20 to the object-to-be-cooled gas flow path 18. In a case where the object-to-be-cooled gas flow path 18 is configured as an integrated piping member continuous from the gas recovery line 20, the outlet 18*b* may refer to a location where the gas pipe 18*c* ends the physical contact with the object 11 to be cooled, or this contact end point may be regarded as the outlet 18*b* of the object-to-be-cooled gas flow path 18. In addition, in a case where the object-to-be-cooled gas flow path 18 passes through the inside of the object 11 to be cooled, the outlet 18*b* may literally refer to a part where the object-to-be-cooled gas flow path 18 exits from the object 11 to be cooled.

In other words, neither the gas supply line 16 nor the gas recovery line 20 is in physical contact with the object 11 to be cooled. The gas supply line 16 extends in a direction away from the object 11 to be cooled from the inlet 18*a* of the object-to-be-cooled gas flow path 18, and the gas recovery line 20 extends in the direction away from in the object 11 to be cooled from the outlet 18*b* of the object-to-be-cooled gas flow path 18. The cryocooler 22 and the cryocooler stage 28 thereof are also disposed apart from the object 11 to be cooled.

The gas supply line 16 connects the gas circulation source 12 to the inlet 18*a* of the object-to-be-cooled gas flow path 18 so as to supply the cooling gas from the gas circulation source 12 via the cryocooler stage 28 to the object-to-be-cooled gas flow path 18. The gas supply line 16 physically contacts the cryocooler stage 28 and is thermally coupled to the cryocooler stage 28 such that the cooling gas is cooled by heat exchange between the cooling gas flowing through the gas supply line 16 and the cryocooler stage 28. Therefore, the cooling gas flows into the gas supply line 16 from the gas circulation source 12, is cooled by the cryocooler stage 28, and flows out from the gas supply line 16 to the object-to-be-cooled gas flow path 18.

Hereinafter, for convenience of description, a portion of the gas supply line 16 from the gas circulation source 12 to the cryocooler stage 28 may be referred to as an upstream part 16*a* of the gas supply line 16, and a portion of the gas supply line 16 from the cryocooler stage 28 to the inlet 18*a* of the object-to-be-cooled gas flow path 18 may be referred to as a downstream part 16*b* of the gas supply line 16. That is, the gas supply line 16 includes the upstream part 16*a* and the downstream part 16*b*.

In addition, a portion of the gas supply line 16 disposed in the cryocooler stage 28 can be referred to as an intermediate part 16*c* of the gas supply line 16. As an example, the intermediate part 16*c* of the gas supply line 16 is a coil-shaped cooling gas pipe disposed in contact with the outer surface of the cryocooler stage 28 so as to surround the periphery of the cryocooler stage 28.

Therefore, the cooling gas has the lowest attainment temperature in the cooling gas flow path 14 at the outlet 16*d* of the intermediate part 16*c* of the gas supply line 16 (that is, the inlet of the downstream part 16*b*).

The gas recovery line 20 connects the outlet 18*b* of the object-to-be-cooled gas flow path 18 to the gas circulation source 12 so as to recover the cooling gas from the object-to-be-cooled gas flow path 18 to the gas circulation source 12. Therefore, the cooling gas flows into the gas recovery line 20 from the object-to-be-cooled gas flow path 18 and flows out from the gas recovery line 20 to the gas circulation source 12.

In addition, the cryogenic cooling system 10 also includes a heat exchanger 30. The heat exchanger 30 is configured such that the cooling gases flowing through the gas supply line 16 and the gas recovery line 20 exchange heat with each other between the gas supply line 16 and the gas recovery line 20. The heat exchanger 30 helps improve the cooling efficiency of the cryogenic cooling system 10.

The heat exchanger 30 includes a high-temperature inlet 30*a* and a low-temperature outlet 30*b* on the gas supply line 16 (more specifically, the upstream part 16*a*), and a low-temperature inlet 30*c* and a high-temperature outlet 30*d* on the gas recovery line 20. A supply-side cooling gas, that is, a high-temperature cooling gas that flows into the heat exchanger 30 from the gas circulation source 12 through the high-temperature inlet 30*a* is cooled by the gas recovery line 20 in the heat exchanger 30, and flows to the cryocooler stage 28 through the low-temperature outlet 30*b*. Along with this, a recovery-side cooling gas, that is, a low-temperature cooling gas flowing into the heat exchanger 30 through the low-temperature inlet 30*c* from the object-to-be-cooled gas flow path 18 is heated by the gas supply line 16 in the heat exchanger 30, and flows to the gas circulation source 12 through the high-temperature outlet 30*d*.

The cryogenic cooling system 10 includes a vacuum chamber 32 that defines a vacuum environment 34. The vacuum chamber 32 is configured to isolate the vacuum environment 34 from a surrounding environment 36. The vacuum chamber 32 is, for example, a cryogenic vacuum chamber such as a cryostat. The vacuum environment 34 is, for example, a cryogenic vacuum environment, and the surrounding environment 36 is, for example, a room temperature and atmospheric pressure environment.

The object 11 to be cooled is disposed in the vacuum chamber 32, that is, in the vacuum environment 34. Among the main components of the cryogenic cooling system 10, the object-to-be-cooled gas flow path 18, the cryocooler stage 28 of the cryocooler 22, and the heat exchanger 30 are disposed in the vacuum environment 34. Meanwhile, the gas circulation source 12 and the compressor 24 of the cryocooler 22 are disposed outside the vacuum chamber 32, that is, in the surrounding environment 36. Therefore, one end of the gas supply line 16 and the gas recovery line 20 connected to the gas circulation source 12 is disposed in the surrounding environment 36, and the remaining portion is disposed in the vacuum environment 34.

The cryogenic cooling system 10 includes a temperature sensor 38 installed in the cryocooler stage 28. Only one temperature sensor 38 is provided in the cooling gas flow path 14 of the cryogenic cooling system 10, specifically, in the gas supply line 16. Therefore, the temperature sensor 38 is provided neither in the object-to-be-cooled gas flow path 18 nor in the object 11 to be cooled. The temperature sensor 38 is also not provided in the gas recovery line 20.

In addition, the installation location of the temperature sensor 38 is not limited to the cryocooler stage 28. The temperature sensor 38 may be installed at any location in the cooling gas flow path 14 including the object-to-be-cooled gas flow path 18. In addition, a plurality of the temperature sensors 38 may be installed at different locations in the cooling gas flow path 14.

The cryogenic cooling system 10 includes a control device 40 that controls the cryogenic cooling system 10. The control device 40 includes a gas flow rate control unit 42. The gas flow rate control unit 42 includes a timer 44 and an initial cooling setting 46. The control device 40 is disposed in the surrounding environment 36. The control device 40 may be installed in the gas circulation source 12, for example, the compressor.

Although the control device 40 of the cryogenic cooling system 10 is realized by elements and circuits including a CPU and memories of a computer as a hardware configuration and realized by a computer program or the like as a software configuration, the control device 40 is appropriately drawn in FIG. 1 as functional blocks realized by the cooperation. Those skilled in the art will understand that these functional blocks can be realized in various ways by combining hardware and software.

Meanwhile, the initial cooling of the cryogenic cooling system 10 is the control processing of the cryogenic cooling system 10 that rapidly cools the object 11 to be cooled from the room temperature to the target cooling temperature, and is performed when the cryogenic cooling system 10 is activated. By the initial cooling, the object 11 to be cooled is cooled from the room temperature to the target cooling temperature. After the completion of the initial cooling, the cryogenic cooling system 10 transits to the steady cooling for maintaining the object 11 to be cooled at the target cooling temperature. The temperature lowering rate in the initial cooling (for example, the average temperature lowering rate of the object 11 to be cooled in the initial cooling) is higher than the temperature lowering rate in the steady cooling.

The control device 40 is configured to start the initial cooling of the object 11 to be cooled in synchronization with the activation the cryogenic cooling system 10. For example, the control device 40 starts the initial cooling of the object 11 to be cooled at the same time as the activation of the cryogenic cooling system 10 or when a predetermined delay time has elapsed from the activation time point of the cryogenic cooling system 10.

Typically, the activation of the cryogenic cooling system 10 means the activation of the gas circulation source 12 or the activation of the gas circulation source 12 and the cryocooler 22. Therefore, the control device 40 may be configured to start the initial cooling of the object 11 to be cooled in synchronization with the activation of the gas circulation source 12. Alternatively, the control device 40 may be configured to start the initial cooling in synchronization with the activation of the gas circulation source 12 and the cryocooler 22.

The cryogenic cooling system 10 includes a main switch 48. The main switch 48 includes an operation tool such as an operation button or switch that can be manually operated, and is configured to output a system activation command signal S2 to the control device 40 when operated. When a worker operates the main switch 48, the cryogenic cooling system 10 is activated and its operation is started. The main switch 48 may function not only as an activation switch of the cryogenic cooling system 10 but also as a stop switch of the cryogenic cooling system 10.

The main switch 48 is disposed in the surrounding environment 36. The main switch 48 may be installed in the control device 40 or its casing. Alternatively, the main switch 48 may be installed in the compressor as an activation switch of the compressor included in the gas circulation source 12. The main switch 48 may be installed in the cryocooler 22, for example, in the compressor 24, as an activation switch of the cryocooler 22.

Alternatively, in a case where a higher-level control device is provided separately from the control device 40, the higher-level control device may be configured to output the system activation command signal S2 to the control device 40. Often, the object 11 to be cooled is a part of the particle accelerator and other higher-level devices or systems, and such higher-level systems are equipped with the higher-level control device.

The control device 40 is configured to start initial cooling in accordance with the received system activation command signal S2. The control device 40 is configured to control the gas circulation source 12 so as to execute the initial cooling of the object 11 to be cooled. During the initial cooling, the control device 40 controls the gas circulation source 12 such that the cooling gas flows through the cooling gas flow path 14 according to a prescribed flow rate pattern. The control device 40 may control the gas circulation source 12 so as to execute the steady cooling of the object 11 to be cooled after the initial cooling or at other appropriate timing.

The gas flow rate control unit 42 is configured to determine the target cooling gas flow rate on the basis of the initial cooling setting 46 and the elapsed time from the start of the initial cooling. The gas flow rate control unit 42 is configured to control the gas circulation source 12 such that the cooling gas flows through the cooling gas flow path 14 at the determined target cooling gas flow rate. The gas flow rate control unit 42 is configured to generate the gas circulation source control signal S1 such that the cooling gas is delivered to the cooling gas flow path 14 at the target cooling gas flow rate by the gas circulation source 12, and outputs the gas circulation source control signal S1 to the gas circulation source 12.

The timer 44 is configured to be able to measure the elapsed time from an any time. The timer 44 is configured to measure the elapsed time in accordance with the system activation command signal S2. The timer 44 can calculate the elapsed time from the start of the initial cooling.

The initial cooling setting 46 predetermines the target cooling gas flow rate at each time from the start to the completion of the initial cooling according to the prescribed flow rate pattern. The initial cooling setting 46 may have a function, a look-up table, a map, or another format representing a correspondence relationship between the elapsed time and the target cooling gas flow rate. The initial cooling settings 46 are created in advance (for example, by the manufacturer of the cryogenic cooling system 10) and stored in the control device 40 or a storage device accompanied thereby.

The target cooling gas flow rate is set, for example, such that the cryogenic cooling system 10 provides sufficient cooling capacity to cool the object 11 to be cooled to the target temperature. The target cooling gas flow rate can be appropriately set for each cooling temperature on the basis of a designer's empirical knowledge or designer's experiments and simulations.

It is convenient to express the cooling gas flow rate as a mass flow rate. As is known, since the mass flow rate is constant at each location of the cooling gas flow path 14, the cooling gas flow rate delivered from the gas circulation source 12 is equal to the cooling gas flow rate flowing through the object-to-be-cooled gas flow path 18. However, when applicable, the flow rate pattern maybe described as a relationship between the volume flow rate and other flow rates and time.

Figure 2A:
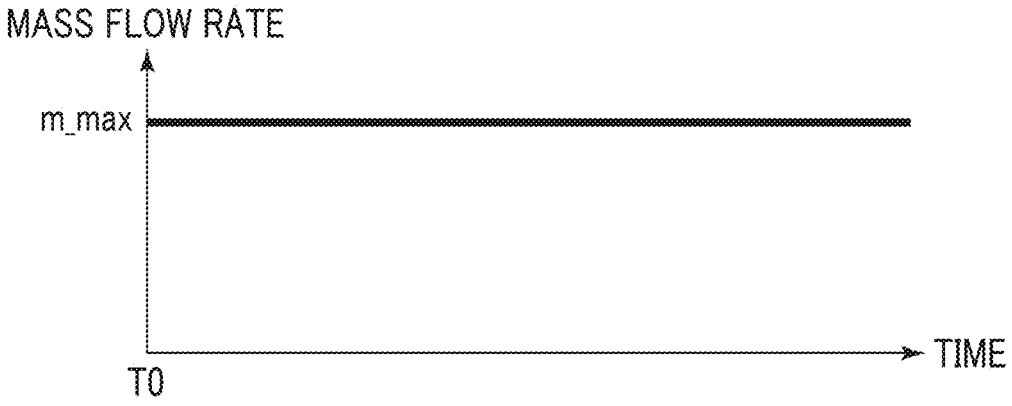
FIGS. 2A and 2B are views illustrating flow rate patterns of a cooling gas that can be used for initial cooling according to a comparative example.
Figure 2B:
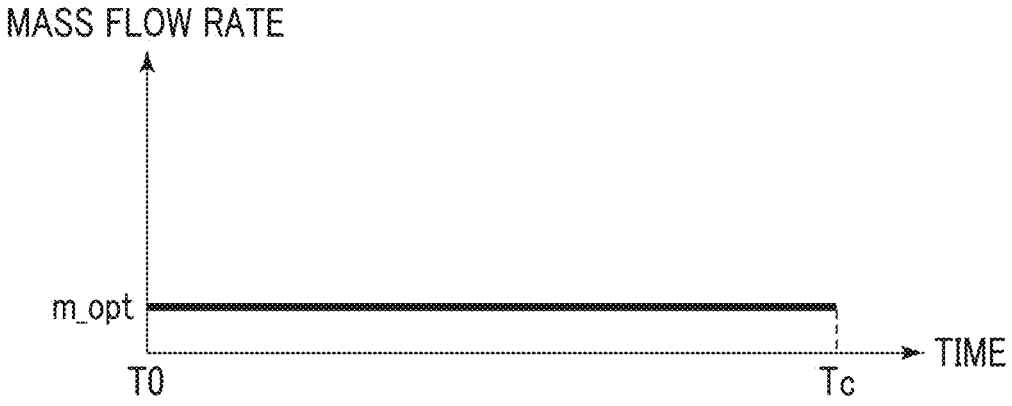

FIGS. 2A and 2B are views illustrating a flow rate pattern of a cooling gas that can be used for initial cooling according to a comparative example. FIGS. 3A to 3D are views illustrating flow rate patterns of a cooling gas that can be used for the initial cooling according to the embodiment. These flow rate patterns represent a relationship between the target mass flow rate of the cooling gas and the elapsed time from the start of the initial cooling. In each figure, a start time point and a completion time point of the initial cooling are denoted as T0 and Tc, respectively.

The flow rate pattern illustrated in FIG. 2A is fixed to an upper limit cooling gas flow rate in the cryogenic cooling system 10. Here, the upper limit cooling gas flow rate may be, for example, a maximum rated flow rate m_max of the cryogenic cooling system 10.

The flow rate pattern illustrated in FIG. 2B is fixed to a cooling gas flow rate used for the steady cooling of the cryogenic cooling system 10. The fixed flow rate maybe referred to as a cooling gas flow rate for maximizing the cooling capacity of the cryogenic cooling system 10 at a target cooling temperature in the steady cooling (hereinafter, also referred to as a steady operation cooling temperature Tf), and an optimal flow rate m_opt. The steady operation cooling temperature Tf typically coincides with the target cooling temperature in the initial cooling. The optimal flow rate m_opt is smaller than the maximum rated flow rate m_max.

As will be described below, the optimal flow rate m_opt has a different value depending on the cooling temperature. Therefore, the optimal flow rate when the cooling temperature is Ta (K) can be denoted as m_opt (Ta) as a function of the temperature Ta. The optimal flow rate at the steady operation cooling temperature Tf is represented by m_opt (Tf).

In the flow rate pattern according to the comparative example, the mass flow rate of the cooling gas flowing through the cooling gas flow path 14 does not change with time. In contrast, in the initial cooling according to the embodiment, the mass flow rate of the cooling gas flowing through the cooling gas flow path 14 changes with time according to the prescribed flow rate pattern. The prescribed flow rate pattern is set such that the mass flow rate of the cooling gas decreases with time.

The prescribed flow rate pattern is predetermined such that the cooling gas flows through the cooling gas flow path 14 at a first average flow rate m1 from a start T0 of the initial cooling to a transition timing T, and the cooling gas flows through the cooling gas flow path 14 at a second average flow rate m2 from the transition timing T to a completion Tc of the initial cooling. The second average flow rate m2 is smaller than the first average flow rate m1 such that the cooling capacity of the cryogenic cooling system 10 is increased as compared to a case where the first average flow rate m1 is maintained from the transition timing T to the completion Tc of the initial cooling.

The prescribed flow rate pattern is predetermined such that the cooling gas flows through the cooling gas flow path 14 at the upper limit cooling gas flow rate in the cryogenic cooling system 10 at least temporarily from the start T0 of the initial cooling to the transition timing T. Here, the upper limit cooling gas flow rate corresponds to, for example, the maximum rated flow rate m_max of the cryogenic cooling system 10, but is not limited to this.

The prescribed flow rate pattern is predetermined such that the cooling gas flow through the cooling gas flow path 14 at a cooling gas flow rate (that is, an optimal flow rate m_opt (Tf) for maximizing the cooling capacity of the cryogenic cooling system 10 at the target cooling temperature at least temporarily from the transition timing T to the completion Tc of the initial cooling.

For convenience of description, hereinafter, a period from the start T0 of the initial cooling to the transition timing T may be referred to as a first half of the initial cooling, and a period from the transition timing T to the completion Tc of the initial cooling may be referred to as a second half of the initial cooling.

The transition timing T is predetermined in a period after the first reference time T1 and before the second reference time T2. The transition timing T is selected from a period from the first reference time T1 to the second reference time T2. It can be said that the transition period from the first half to the second half of the initial cooling is determined by the first reference time T1 and the second reference time T2. As will be described below, the first reference time T1 and the second reference time T2 give a rough standard for setting the transition timing T.

Figure 3A:
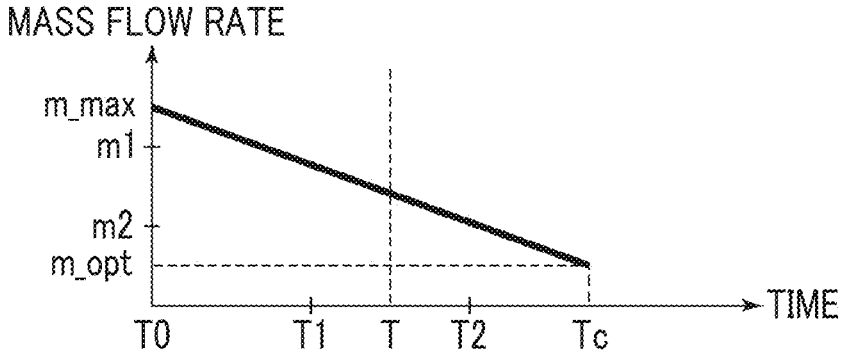
FIGS. 3A to 3D are views illustrating flow rate patterns of a cooling gas that can be used for initial cooling according to the embodiment.

The prescribed flow rate pattern illustrated in FIG. 3A is determined such that the mass flow rate of the cooling gas decreases with a constant gradient from the start T0 of the initial cooling to the completion Tc thereof. That is, the prescribed flow rate pattern has a constant mass flow rate decrease rate from the start T0 of the initial cooling to the completion Tc thereof. The prescribed flow rate pattern has the maximum rated flow rate m_max at the start T0 of the initial cooling and the optimal flow rate m_opt at the completion Tc of the initial cooling. However, the initial flow rate value and finish value of the flow rate pattern are not limited to these. For example, the initial flow rate value may be smaller than the maximum rated flow rate m_max.

Therefore, the flow rate pattern illustrated in FIG. 3A has the first average flow rate m1 in the first half of the initial cooling and the second average flow rate m2 in the second half of the initial cooling. The second average flow rate m2 is smaller than the first average flow rate m1. The first average flow rate m1 is smaller than the maximum rated flow rate m_max. The second average flow rate m2 is larger than the optimal flow rate m_opt at the target cooling temperature of the initial cooling.

Figure 3B:
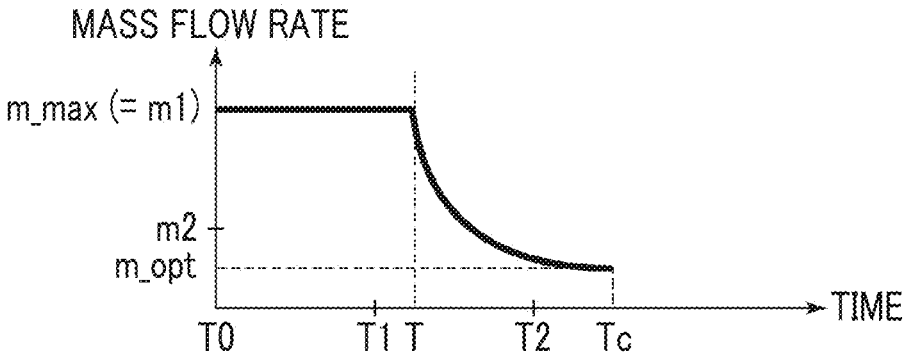

The prescribed flow rate pattern illustrated in FIG. 3B is determined such that the mass flow rate of the cooling gas decreases at least temporarily with a non-constant gradient during the initial cooling. The prescribed flow rate pattern is determined such that the mass flow rate of the cooling gas is fixed to a constant value in the first half of the initial cooling and decreases with a gradient that decreases with time in the second half of the initial cooling. The prescribed flow rate pattern has the maximum rated flow rate m_max in the first half of the initial cooling, and has the optimal flow rate m_opt at the target cooling temperature of the initial cooling at the completion Tc of the initial cooling.

The prescribed flow rate pattern may be predetermined such that the cooling gas flows through the cooling gas flow path 14 at a cooling gas flow rate for maximizing the cooling capacity of the cryogenic cooling system 10 at an expected cooling temperature at each time at least temporarily during the initial cooling. The prescribed flow rate pattern illustrated in FIG. 3B is determined such that a cooling gas flow rate optimal for the expected cooling temperature at each time is obtained in the second half of the initial cooling.

Therefore, the flow rate pattern illustrated in FIG. 3B also has the first average flow rate m1 in the first half of the initial cooling, the second average flow rate m2 in the second half of the initial cooling, and the second average flow rate m2 is smaller than the first average flow rate m1. The first average flow rate m1 is equal to the maximum rated flow rate m_max. The second average flow rate m2 is larger than the optimal flow rate m_opt at the target cooling temperature.

Figure 3C:
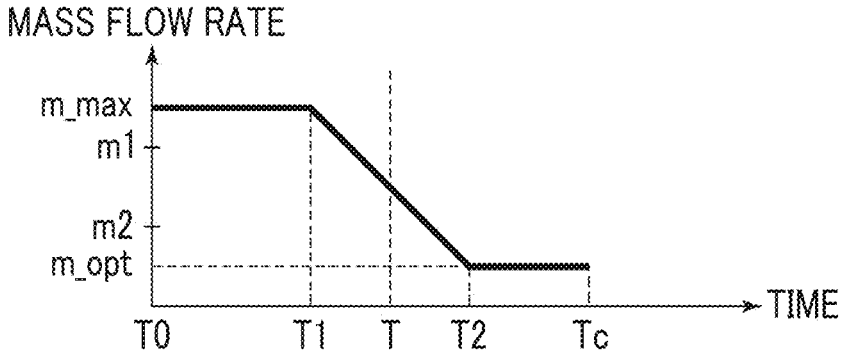

The prescribed flow rate pattern illustrated in FIG. 3C is also determined such that the mass flow rate of the cooling gas decreases with time, similarly to the above-described flow rate pattern. The prescribed flow rate pattern is temporarily fixed to the first constant value in the first half of the initial cooling, and is temporarily fixed to the second constant value in the second half of the initial cooling. The second constant value is smaller than the first constant value. More specifically, the prescribed flow rate pattern can take the maximum rated flow rate m_max as the first constant value from the start T0 of the initial cooling to the first reference time T1, and can take the optimal flow rate m_opt as the second constant value from the second reference time T2 to the completion Tc of the initial cooling. The prescribed flow rate pattern is determined such that the mass flow rate of the cooling gas decreases with a constant (may be non-constant) gradient from the first reference time T1 to the second reference time T2.

Therefore, the flow rate pattern illustrated in FIG. 3C also has the first average flow rate m1 in the first half of the initial cooling, the second average flow rate m2 in the second half of the initial cooling, and the second average flow rate m2 is smaller than the first average flow rate m1.

Figure 3D:
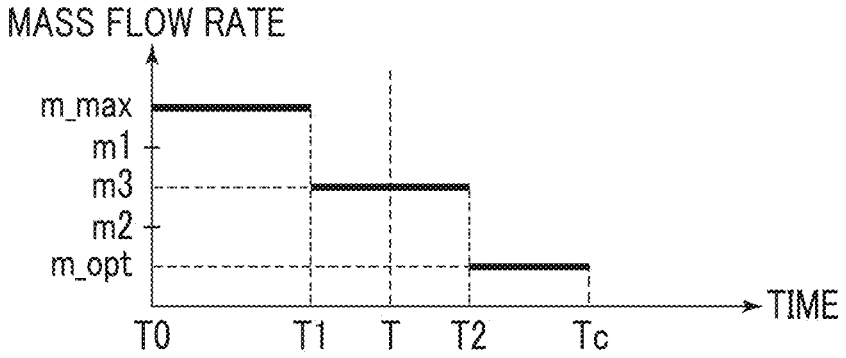

As illustrated in FIG. 3D, in the prescribed flow rate pattern, the mass flow rate of the cooling gas may be fixed to an intermediate constant value from the first reference time T1 to the second reference time T2. The intermediate constant value m3 is smaller than the first constant value (for example, the maximum rated flow rate m_max) and larger than the second constant value (for example, the optimal flow rate m_opt). Similarly, the flow rate pattern illustrated in FIG. 3D also has the first average flow rate m1 in the first half of the initial cooling, the second average flow rate m2 in the second half of the initial cooling, and the second average flow rate m2 is smaller than the first average flow rate m.

In the exemplified prescribed flow rate pattern, the cooling gas flow rate monotonically decreases with time, but this is not essential. The prescribed flow rate pattern may have an aspect in which the cooling gas flow rate temporarily increases.

Figure 4A:
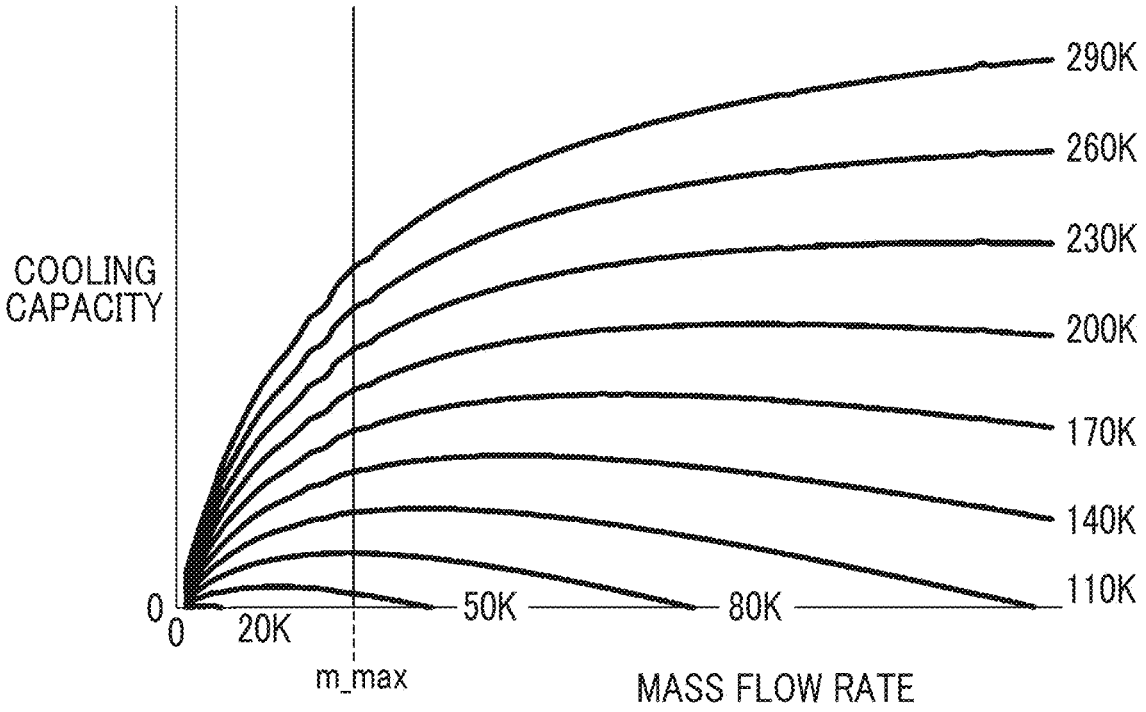
FIGS. 4A and 4B are graphs illustrating cooling capacity curves of the cryogenic cooling system 10 with respect to a plurality of cooling temperatures.
Figure 4B:
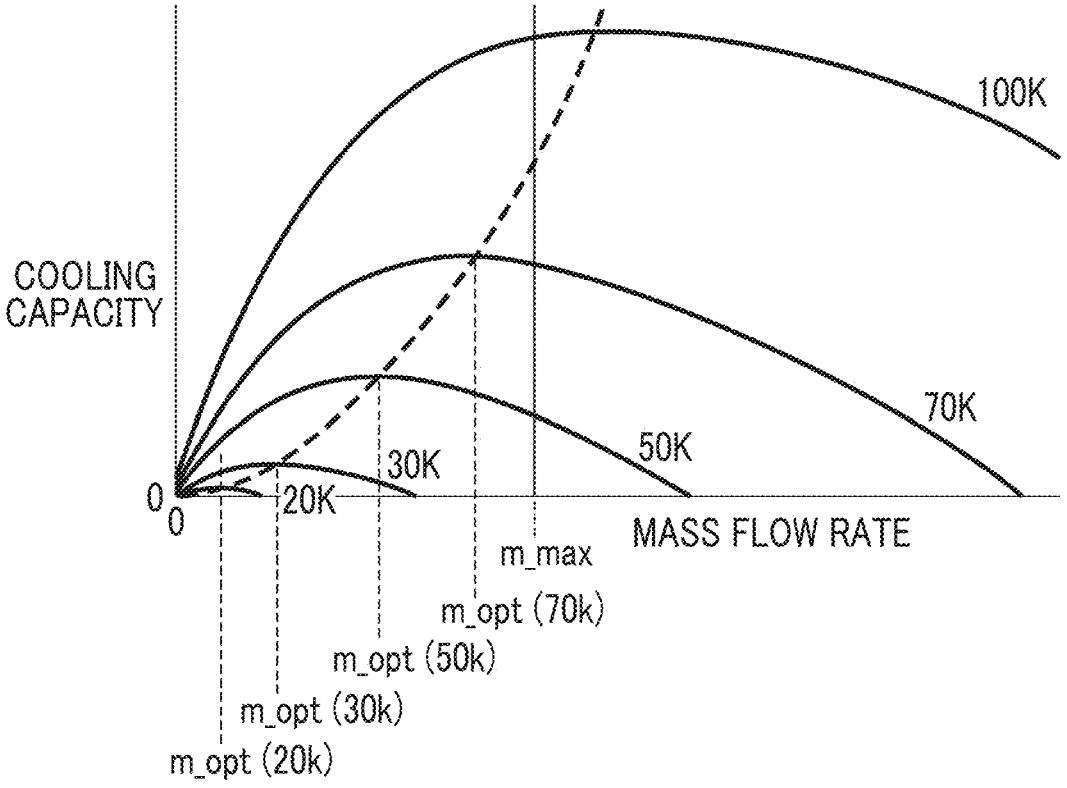

FIGS. 4A and 4B are graphs illustrating cooling capacity curves of the cryogenic cooling system 10 with respect to a plurality of cooling temperatures. The changes in the cooling capacity of the cryogenic cooling system 10 with respect to the mass flow rate of the cooling gas flowing through the cooling gas flow path 14 are illustrated. These cooling capacity curves are the results of calculation by the present inventors. In FIG. 4A, the cooling capacity of the cryogenic cooling system 10 is plotted with respect to several typical temperatures selected from the entire temperature range from the room temperature to the target cooling temperature of the initial cooling. FIG. 4B is an enlarged view of FIG. 4A for a temperature range of 100 K or lower, and the cooling capacity of the cryogenic cooling system 10 is plotted with respect to several typical temperatures.

As can be seen from the figure, the cooling capacity curve has a maximum at a specific mass flow rate. The optimal mass flow rate for maximizing the cooling capacity depends on the cooling temperature, and specifically, the lower the cooling temperature, the smaller the optimal mass flow rate. In addition, in the cooling capacity curve for one certain cooling temperature, the cooling capacity decreases at a mass flow rate smaller than the optimal mass flow rate because the amount of heat by which the cooling gas can be carried away from the object 11 to be cooled by heat exchange between the cooling gas and the object 11 to be cooled at such a small flow rate can be small at such a small flow rate. In addition, the reason why the cooling capacity decreases at a mass flow rate larger than the optimal mass flow rate is due to the restriction by the cooling capacity of the cryocooler 22. As the cooling gas flow rate increases, the heat exchange between the cooling gas and the cryocooler stage 28 maybe insufficient, and the temperature of the cooling gas flowing to the object 11 to be cooled may increase.

FIG. 4A illustrates the upper limit cooling gas flow rate (for example, the maximum rated flow rate m_max) in the cryogenic cooling system 10. At the room temperature or a relatively high-temperature range (in a range of 290 K to 110 K in FIG. 4A), the upper limit flow rate of the cooling system is smaller than the mass flow rate that gives the maximum value of the cooling capacity. Thus, in this high temperature region, the cryogenic cooling system 10 can achieve the maximum cooling capacity by causing the cooling gas to flow through the cooling gas flow path 14 at the upper limit cooling gas flow rate.

On the other hand, in a relatively low temperature range including the target cooling temperature of the initial cooling (about 100 K or lower in FIG. 4B), the optimal mass flow rate that gives the maximum value of the cooling capacity is also smaller than the upper limit flow rate of the cryogenic cooling system 10. For example, the optimal mass flow rate (m_opt (70 K), m_opt (50 K), m_opt (30 K), m_opt (20 K)) when the cooling temperature is 70 K, 50 K, 30 K, 20 K is smaller than the maximum rated flow rate m_max.

Thus, in this low temperature region, the cryogenic cooling system 10 can achieve the maximum cooling capacity by reducing the cooling gas flow rate from the upper limit cooling gas flow rate to the optimal flow rate. In FIG. 4B, a line connecting the maximum values of the plurality of cooling capacity curves is illustrated by a broken line. By reducing the mass flow rate of the cooling gas according to this broken line as the temperature decreases due to cooling, the cryogenic cooling system 10 can achieve the maximum cooling capacity for each cooling temperature.

The changes in temperature in a case where the initial cooling is executed according to a certain flow rate pattern in the cryogenic cooling system 10 can be predicted. For example, the temperature of the object 11 to be cooled at each time during the initial cooling can be calculated by performing a simulation using an appropriate thermodynamic model. In particular, since the object 11 to be cooled is in an unused state or an idling state during the initial cooling, the heat generation amount of the object 11 to be cooled can be regarded as constant, and the calculation can be performed relatively simply. Since various known techniques can be used for such a thermodynamic calculation, a detailed description thereof will be omitted herein.

As a result of the calculation, it is possible to obtain the time changes of the expected cooling temperature. The optimal flow rate of the cooling gas can be obtained from the expected cooling temperature by referring to the above-described cooling capacity curves. Therefore, a flow rate pattern that gives the cooling gas flow rate for maximizing the cooling capacity of the cryogenic cooling system 10 at each time can be determined from the expected cooling temperature at each time. In this way, the flow rate pattern illustrated in FIG. 3B can be predetermined.

Another important thing to be understood from FIG. 4A is that, in a cryogenic temperature region (about 40 K or lower in FIGS. 4A and 4B) in the vicinity of the target cooling temperature of the initial cooling, the cooling capacity does not occur (that is, the heating occurs) even if the cooling gas is caused to flow at the upper limit flow rate of the cryogenic cooling system 10. Therefore, even if the cooling gas is caused to continue to flow at the upper limit flow rate as in the flow rate pattern according to the comparative example illustrated in FIG. 2A, the object 11 to be cooled cannot be cooled to the target cooling temperature (as described above, for example, 30 K or lower). Then, the initial cooling of the cryogenic cooling system 10 cannot be completed.

Figure 5:
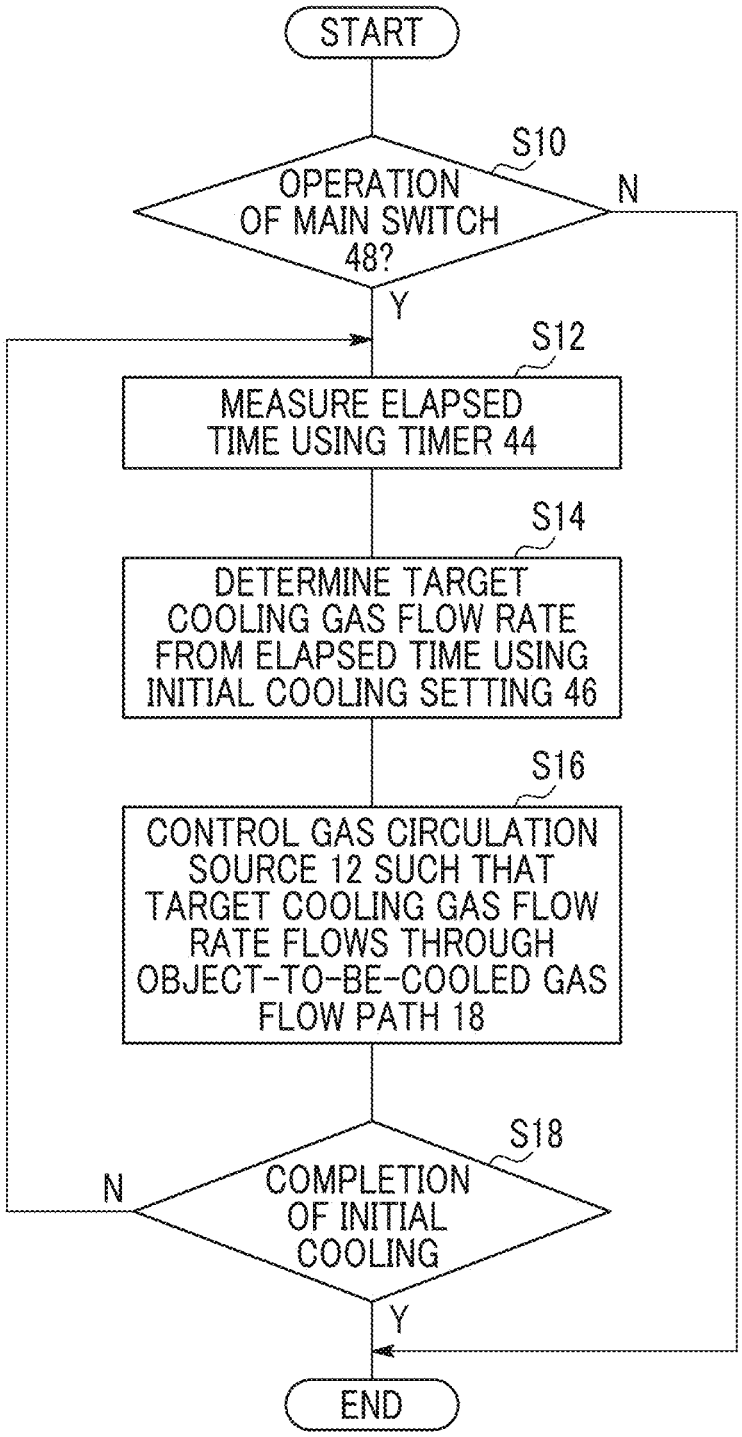
FIG. 5 is a flowchart illustrating a control method for the initial cooling of the cryogenic cooling system according to the embodiment.

FIG. 5 is a flowchart illustrating a control method for the initial cooling of the cryogenic cooling system 10 according to the embodiment. A control routine illustrated in FIG. 5 is executed by the control device 40 when the cryogenic cooling system 10 is activated.

First, it is determined whether the main switch 48 has been operated (S10). The gas flow rate control unit 42 of the control device 40 determines whether or not the system activation command signal S2 is input from the main switch 48 to the gas flow rate control unit 42. In a case where the system activation command signal S2 is not input (N in S10), it is not necessary to perform the initial cooling. Thus, the processing is terminated.

In a case where the system activation command signal S2 is input (Y in S10), the initial cooling of the cryogenic cooling system 10 is started. In this case, the elapsed time from the start of the initial cooling is measured using the timer 44 (S12). Next, the target cooling gas flow rate is determined from the elapsed time using the flow rate pattern prescribed in the initial cooling setting 46 (S14). The gas flow rate control unit 42 determines the target cooling gas flow rate corresponding to the elapsed time according to the flow rate pattern of the initial cooling setting 46.

The gas flow rate control unit 42 controls the gas circulation source 12 such that the cooling gas is caused to flow_through the object-to-be-cooled gas flow path 18 at the determined target cooling gas flow rate (S16). From the determined target cooling gas flow rate, the gas flow rate control unit 42 generates a gas circulation source control signal S1 that realizes this target flow rate. The gas circulation source control signal S1 represents an operating parameter of the gas circulation source 12 that determines the flow rate of the cooling gas supplied to the cooling gas flow path 14 by the gas circulation source 12. The gas circulation source control signal S1 may represent, for example, the rotation speed of a motor that drives the gas circulation source 12. Alternatively, the gas circulation source control signal S1 may be a gas flow rate instruction signal representing the determined target cooling gas flow rate. In this case, the gas circulation source 12 may be configured to control the supplied cooling gas flow rate according to the gas flow rate instruction signal.

The gas flow rate control unit 42 determines whether or not the elapsed time from the start of the initial cooling reaches an initial cooling completion time (Tc) (S18). In a case where the initial cooling completion time has not been reached (N of S18), the gas flow rate control unit 42 continues the initial cooling. That is, the gas flow rate control unit 42 executes the above-described S12 to S18 again. In a case where the initial cooling completion time has been reached (Y in S18), the gas flow rate control unit 42 ends the initial cooling.

In this way, the initial cooling can be automatically executed when the cryogenic cooling system 10 is activated. The gas flow rate control unit 42 starts the initial cooling of the cryogenic cooling system 10 in accordance with the system activation command signal S2, generates the gas circulation source control signal S1 according to the prescribed flow rate pattern, and outputs the gas circulation source control signal S1 to the gas circulation source 12. The gas circulation source 12 operates according to the gas circulation source control signal S1, so that the target cooling gas flow rate can be caused to flow through the object-to-be-cooled gas flow path 18. If the initial cooling is completed, the steady cooling of the object 11 to be cooled can be started.

In addition, the initial cooling setting 46 may include a plurality of flow rate patterns that respectively correspond to a plurality of target cooling temperatures that can be used. The target cooling temperature for the initial cooling is set by a user of the cryogenic cooling system 10, for example. The gas flow rate control unit 42 may select a flow rate pattern corresponding to the set target cooling temperature. The gas flow rate control unit 42 may determine the target cooling gas flow rate according to the selected flow rate pattern.

In addition, in the above-described control processing, the initial cooling of the cryogenic cooling system 10 is automatically started with the operation of the main switch 48, but this is not essential. Independently from the operation of the main switch 48, the initial cooling may be started, for example, by manual setting by the user of the cryogenic cooling system 10. Alternatively, the initial cooling may be automatically started under the control of the higher-level control device.

Figure 6:
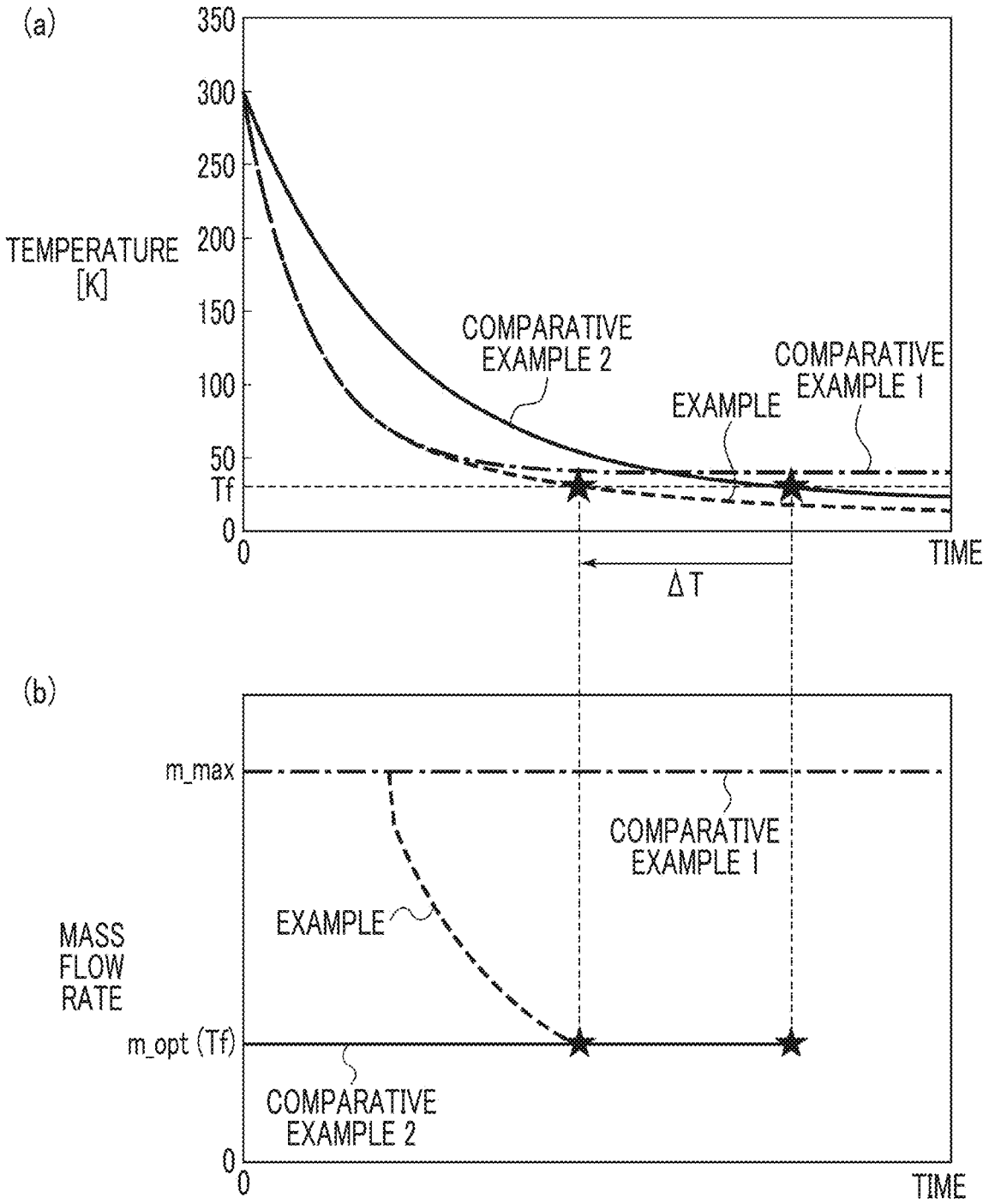
FIG. 6(*a*) illustrates temperature changes in the initial cooling of the cryogenic cooling system, and FIG. 6(*b*) illustrates flow rate patterns used for the initial cooling.

FIG. 6(*a*) illustrates temperature changes in the initial cooling of the cryogenic cooling system 10, and FIG. 6(*b*) illustrates flow rate patterns used for the initial cooling. FIGS. 6(*a*) and 6(*b*) illustrate the temperature changes of the initial cooling according to the example together with the temperature changes according to the two comparative examples. These temperature change graphs are the results of calculation by the present inventors. In addition, these results are obtained on the basis of several assumptions, for example, that the heat capacity of the material of the object 11 to be cooled is constant irrespective of the temperature in order to favorably simulate temperature changes occurring in reality changes while reducing the calculation load.

Similarly to that illustrated in FIG. 3B, the flow rate pattern used for an example is that the cooling gas flow rate is fixed to the maximum rated flow rate m_max in the first half of the initial cooling and is preset to the optimal flow rate m_opt based on the expected cooling temperature in the second half of the initial cooling. In the flow rate pattern used for Comparative Example 1, the cooling gas flow rate is always fixed to the maximum rated flow rate m_max, similarly to that illustrated in FIG. 2A. In the flow rate pattern used for Comparative Example 2, the cooling gas flow rate is always fixed to the optimal flow rate m_opt (Tf) at the steady operation cooling temperature Tf, similarly to the flow rate pattern illustrated in FIG. 2B.

In Comparative Example 1, since the cooling gas flows at a large flow rate, the temperature lowering rate in a high temperature region is relatively high. However, since the cooling gas having a large flow rate cannot generate the cooling capacity in the low temperature region as described above, in Comparative Example 1, the temperature cannot be lowered to the steady operation cooling temperature Tf. The initial cooling is not completed.

In Comparative Example 2, since the cooling gas flows at a small flow rate, the temperature lowering rate in the high temperature region is also small. Unlike Comparative Example 1, the temperature can be lowered to the steady operation cooling temperature Tf, and the initial cooling can be completed. However, since the temperature lowering rate in the high temperature region is small, it takes a relatively long time to complete the initial cooling.

According to the example, since the cooling gas is caused to flow at a large flow rate in the first half of the initial cooling, it is possible to increase the temperature lowering rate in the high temperature region. Particularly, by causing the cooling gas to flow at the maximum rated flow rate m_max, the maximum cooling capacity available for the cryogenic cooling system 10 can be exhibited. In the second half of the initial cooling, the cooling gas flow rate changes at the optimal flow rate with time. Thus, a large cooling capacity can be utilized even in the second half of the initial cooling. Therefore, the time required for the initial cooling can be shortened. As illustrated in the figure, the time required for the initial cooling is shortened by ΔT in the example with respect to Comparative Example 2.

As described above, according to the cryogenic cooling system 10 according to the embodiment, the initial cooling is executed according to the prescribed flow rate pattern. The prescribed flow rate pattern is predetermined such that the cooling gas flows through the cooling gas flow path 14 at a first average flow rate m1 from a start T0 of the initial cooling to a transition timing T, and the cooling gas flows through the cooling gas flow path 14 at a second average flow rate m2 from the transition timing T to a completion Tc of the initial cooling. The second average flow rate m2 is smaller than the first average flow rate m1 such that the cooling capacity of the cryogenic cooling system 10 is increased as compared to a case where the first average flow rate m1 is maintained from the transition timing T to the completion Tc of the initial cooling.

By doing so, since the cooling capacity of the cryogenic cooling system 10 can be increased in both the first half and the second half of the initial cooling, and the object 11 to be cooled can be efficiently cooled, the time required for the initial cooling can be shortened.

In addition, for example, in another technique such as feedback control of the cooling gas flow rate using the measured temperature requires a temperature measurement sensor and a feedback control system. Thus, the configuration becomes more complicated. In contrast, according to the embodiment, since the cooling gas flow rate is controlled in an open loop without using feedback, a relatively simple control system can be adopted, and advantages such as reduction of failure risk and cost reduction can also be obtained.

In addition, since the control device 40 starts the initial cooling in synchronization with the activation of the gas circulation source 12 or the activation of the gas circulation source 12 and the cryocooler 22. By doing so, since the activation and the initial cooling of the components such as the gas circulation source 12 of the cryogenic cooling system 10 are automatically and collectively performed, the operability of the cryogenic cooling system 10 is improved for a worker compared to a case where the activation and the initial cooling are individually performed.

The prescribed flow rate pattern is predetermined such that the cooling gas flows through the cooling gas flow path 14 at the upper limit cooling gas flow rate in the cryogenic cooling system 10 at least temporarily in the first half of the initial cooling. As described above, the cooling capacity in the first half of the initial cooling, that is, in a state where the temperature of the cryogenic cooling system 10 is relatively high can be increased, and the object 11 to be cooled can be efficiently cooled.

The prescribed flow rate pattern is predetermined such that the cooling gas flows through the cooling gas flow path 14 at a cooling gas flow rate for maximizing the cooling capacity of the cryogenic cooling system 10 at the target cooling temperature at least temporarily in the second half of the initial cooling. By doing so, as described above, the cooling capacity in the second half of the initial cooling can be increased, and the object 11 to be cooled can be efficiently cooled.

In a case where the transition timing T is too late, cooling in the cryogenic temperature region is hindered as in Comparative Example 1, and it may take a long time for initial cooling. In addition, in a case where the transition timing T is too early, the temperature lowering rate in the high temperature region becomes large as in Comparative Example 2, and the time required for the initial cooling can be extended. For that reason, it is desired that the transition timing T be set appropriately. The transition timing T can be appropriately set on the basis of a designer' s empirical knowledge or designer' s experiments or simulations. The rough standard for the transition timing T can also be given as described below.

The transition timing T is predetermined in a period after the first reference time T1 and before the second reference time T2. The first reference time T1 may be expressed as a ratio of the amount of heat to be removed from the object 11 to be cooled by the initial cooling to the cooling capacity of the cryogenic cooling system 10 at a first typical temperature Tr1. The second reference time T2 may be expressed as a ratio of the amount of heat to be removed from the object 11 to be cooled by the initial cooling to the cooling capacity of the cryogenic cooling system 10 at a second typical temperature Tr2. The first typical temperature Tr1 and the second typical temperature Tr2 may be selected from the temperature range from the room temperature to the target cooling temperature, and the second typical temperature Tr2 may be lower than the first typical temperature Tr1.

That is, the transition timing T is set such that "first reference time T1≤transition timing T≤second reference time T2", and this inequality can be described as follows.

$$\frac{\sum \int_{T_L}^{T_{RT}} M_i c_{Pi} dT}{Q_{cryocooler}(T_{r1})} \leqq T \leqq \frac{\sum \int_{T_L}^{T_{RT}} M_i c_{Pi} dT}{Q_{cryocooler}(T_{r2})} \quad \text{[Equation 1]}$$

Here, $T_{RT}$ is a room temperature, $T_L$ is a target temperature, Mi is a mass of a cooling target component (for example, the object 11 to be cooled), and $c_{pi}$ is a (constant pressure) specific heat of the cooling target component. i represents the type of component. $Q_{cryocooler}$ (Tr1) indicates the cooling capacity of the cryocooler 22 at the first typical temperature Tr1, and $Q_{cryocooler}$ (Tr2) indicates the cooling capacity of the cryocooler 22 at the second typical temperature Tr2. In a case where the second typical temperature Tr2 is lower than the first typical temperature Tr1, generally, $Q_{cryocooler}$ (Tr1)>$Q_{cryocooler}$ (Tr2) is established.

In short, the first reference time T1 gives a rough standard for the time until the object 11 to be cooled is cooled to the first typical temperature Tr1. The second reference time T2 gives a rough standard for the time until the object 11 to be cooled is cooled to the second typical temperature Tr2. For example, the first typical temperature Tr1 may be a liquid nitrogen temperature or a temperature in the vicinity thereof. The second typical temperature Tr2 may be the upper limit temperature of the temperature range in which the object 11 to be cooled should be maintained during steady cooling or a temperature in the vicinity thereof. This makes it easy to set the transition timing T appropriately. In addition, the cooling capacity of the cryocooler 22 in the above inequality does not need to be a value at a certain typical temperature, but may be an average value of the cooling capacity in a certain temperature range.

Figure 7:
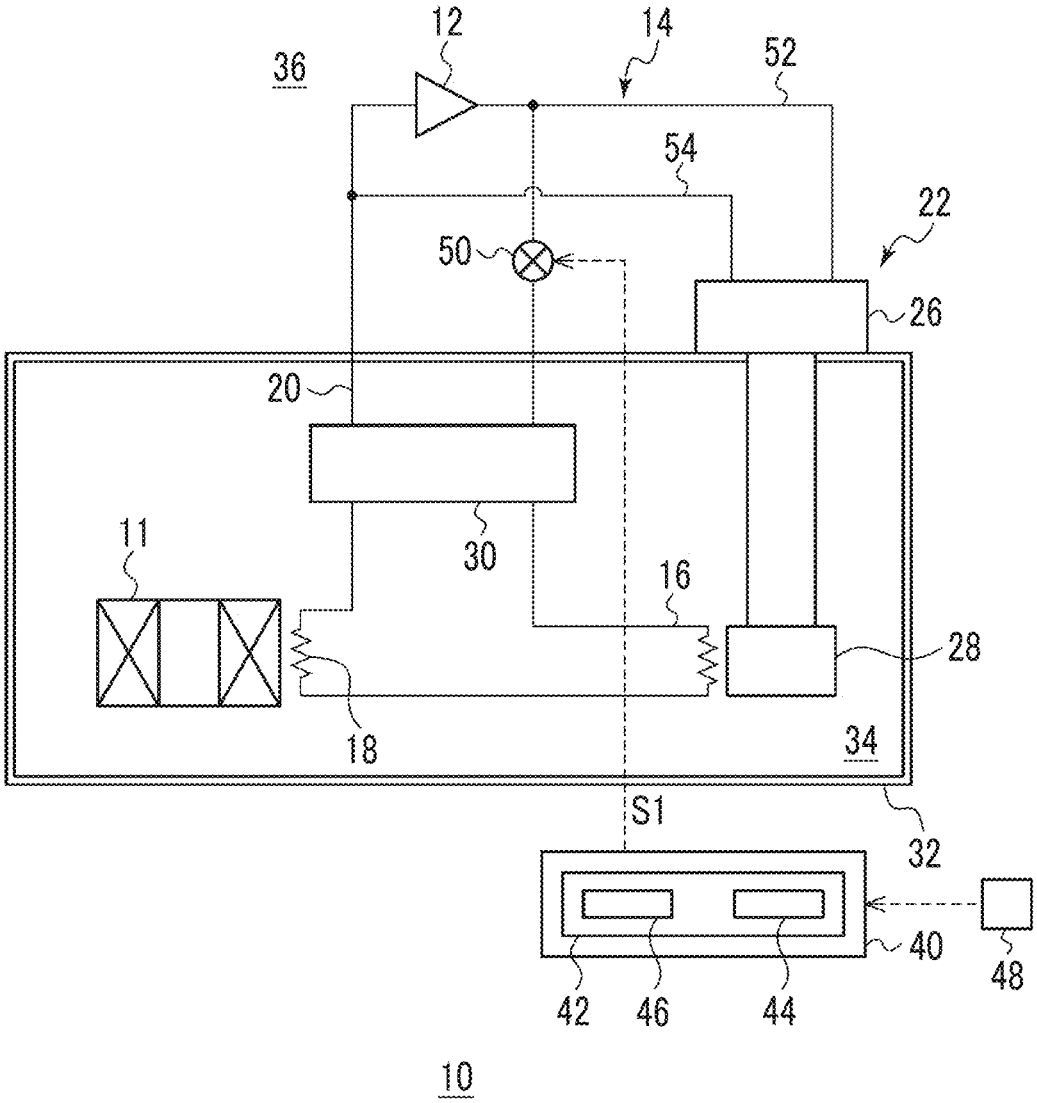
FIG. 7 is a view schematically illustrating another example of the cryogenic cooling system according to the embodiment.

FIG. 7 is a view schematically illustrating another example of the cryogenic cooling system 10 according to the embodiment. The cryogenic cooling system 10 illustrated is different from the cryogenic cooling system 10 illustrated in FIG. 1 with respect to the flow path configuration of the cooling gas, but the rest is generally common. Hereinafter, different configurations will be mainly described, and common configurations will be briefly described or description thereof will be omitted.

The cryogenic cooling system 10 includes a gas circulation source 12 and a cooling gas flow path 14. The cooling gas flow path 14 includes a gas supply line 16, an object-to-be-cooled gas flow path 18, and a gas recovery line 20. The cryogenic cooling system 10 includes a cryocooler 22, a heat exchanger 30, and a vacuum chamber 32 that defines a vacuum environment 34. The cryocooler 22 includes a cold head 26 having a cryocooler stage 28. The gas circulation source 12 is disposed in the surrounding environment 36.

As described above, both the cooling gas and the working gas of the cryocooler 22 may be helium gas. In this way, in a case where the cooling gas and the working gas are the same gas, the cryogenic cooling system 10 may be provided with one common compressor. That is, the gas circulation source 12 not only cause the cooling gas to flow through the cooling gas flow path 14, but also functions as a compressor for circulating the working gas through the cryocooler 22.

In this case, in order to control the flow rate of the cooling gas, the gas circulation source 12 may include a flow rate control valve 50 configured to control the flow rate of the cooling gas flowing through the object-to-be-cooled gas flow path 18. The flow rate control valve 50 is configured to control the cooling gas flow rate to be supplied, according to the gas circulation source control signal S1.

A cryocooler supply line 52 is provided to supply the working gas from the gas circulation source 12 to the cryocooler 22, and a cryocooler recovery line 54 is provided to recover the working gas from the cryocooler 22 to the gas circulation source 12. The cryocooler supply line 52 is branched from the gas supply line 16 in the surrounding environment 36 and connected to the cold head 26, and the cryocooler recovery line 54 is branched from the gas recovery line 20 in the surrounding environment 36 and connected to the cold head 26.

The flow rate control valve 50 is installed in the gas supply line 16 in the surrounding environment 36. Alternatively, the flow rate control valve 50 may be installed in the gas recovery line 20 in the surrounding environment 36. By doing so, a general-purpose flow rate control valve can be adopted as the flow rate control valve 50, which is advantageous in terms of manufacturing cost as compared to a case where the flow rate control valve 50 is installed in the vacuum environment 34. However, the flow rate control valve 50 may be installed in the vacuum environment 34.

In addition, the cryogenic cooling system 10 also includes a control device 40 including a gas flow rate control unit 42, a timer 44, and an initial cooling setting 46, and a main switch 48.

Even in this case, similarly to the already-described embodiment, the cooling capacity of the cryogenic cooling system 10 can be increased and the object 11 to be cooled can be efficiently cooled. Thus, the time required for the initial cooling can be shortened. Since the cooling gas flow rate is controlled in an open loop without using feedback, a relatively simple control system can be adopted, and advantages such as reduction of failure risk and cost reduction can be obtained.

Even in a case where the gas circulation source 12 and the compressor 24 of the cryocooler 22 are separately provided as in the cryogenic cooling system 10 illustrated in FIG. 1, the cryogenic cooling system 10 may include a flow rate control valve 50 in the cooling gas flow path 14. The flow rate control valve 50 may be disposed, for example, in the gas supply line 16 in the surrounding environment 36.

The present invention has been described above on the basis of the embodiments. It is understood by those skilled in the art that the present invention is not limited to the above-described embodiment, various design changes can be made, various modifications can be made, and such modifications are also within the scope of the present invention.

Various features described in connection with one embodiment may also be applicable to other embodiments. The new embodiments that result from the combination also have the effects of each of the combined embodiments.

The present invention can be utilized in the field of cryogenic cooling systems.

It should be understood that the invention is not limited to the above-described embodiment, but may be modified into various forms on the basis of the spirit of the invention. Additionally, the modifications are included in the scope of the invention.

What is claimed is:

1. A cryogenic cooling system comprising:

a gas circulation source configured to circulate a cooling gas;

a cryocooler that comprises a cryocooler stage, the cryocooler stage is configured to cool the cooling gas;

a cooling gas flow path configured to cause a cooling gas to flow from the gas circulation source via the cryocooler stage and an object to be cooled to the gas circulation source; and a control device configured to control the gas circulation source to execute initial cooling of the object to be cooled from a room temperature to a target cooling temperature according to a prescribed flow rate pattern, wherein the prescribed flow rate pattern is predetermined such that the cooling gas flows through the cooling gas flow path at a first average flow rate from a start of the initial cooling to a transition timing, and the cooling gas flows through the cooling gas flow path at a second average flow rate from the transition timing to a completion of the initial cooling, and wherein the second average flow rate is smaller than the first average flow rate such that a cooling capacity of the cryogenic cooling system is increased as compared to a case where the first average flow rate is maintained from the transition timing to the completion of the initial cooling.

2. The cryogenic cooling system according to claim 1, wherein the control device is configured to start the initial cooling in synchronization with activation of the gas circulation source or activation of the gas circulation source and the cryocooler.

3. The cryogenic cooling system according to claim 1, wherein the first average flow rate is set to an upper limit cooling gas flow rate in the cryogenic cooling system at least temporarily from the start of the initial cooling to the transition timing.

4. The cryogenic cooling system according to claim 1, wherein the second average flow rate is set to a cooling gas flow rate for maximizing the cooling capacity of the cryogenic cooling system at the target cooling temperature at least temporarily from the transition timing to the completion of the initial cooling.

5. The cryogenic cooling system according to claim 1, wherein the transition timing is predetermined in a period after a first reference time and before a second reference time, wherein the first reference time is expressed as a ratio of an amount of heat to be removed from the object to be cooled by the initial cooling to the cooling capacity of the cryogenic cooling system at a first temperature, and the second reference time is expressed as a ratio of the amount of heat to be removed from the object to be cooled by the initial cooling to the cooling capacity of the cryogenic cooling system at a second temperature, and wherein the first temperature and the second temperature are selected from a temperature range from the room temperature to the target cooling temperature, and the second temperature is lower than the first temperature.

6. The cryogenic cooling system according to claim 1, wherein the control device comprises:

an initial cooling setting that is configured to predetermine a target cooling gas flow rate at each time from the start to the completion of the initial cooling; and a gas flow rate control unit that is configured to determine the target cooling gas flow rate in accordance with the initial cooling setting and an elapsed time from the start of the initial cooling, and controls the gas circulation source such that the cooling gas flows through the cooling gas flow path at the target cooling gas flow rate.

* * * * *